United States Patent [19]

Llera

[11] 4,342,400

[45] Aug. 3, 1982

[54] TAMPER INDICATING CLOSURE AND PRESSURIZED CONTAINER

[75] Inventor: Santos A. A. Llera, Calle Carite, P.R.

[73] Assignee: Precision Plastic Products Corp., Toa Baja, P.R.

[21] Appl. No.: 185,888

[22] Filed: Sep. 10, 1980

[51] Int. Cl.[3] ..... B65D 41/48

[52] U.S. Cl. ..... 215/256

[58] Field of Search ..... 220/268, 269; 215/256, 215/31, 252

[56] References Cited

U.S. PATENT DOCUMENTS

| | | | |
|---|---|---|---|
| 2,950,834 | 10/1957 | Mazza . | |
| 2,993,612 | 5/1959 | Trautvetter . | |
| 3,032,226 | 5/1962 | Terwilliger . | |
| 3,109,547 | 11/1963 | Wood . | |
| 3,441,161 | 4/1969 | Van Baarn | 215/256 X |
| 3,559,833 | 2/1971 | Alonso | 215/31 |
| 3,924,771 | 12/1975 | Cleff | 215/256 X |
| 3,927,784 | 12/1975 | Cochrane | 215/256 |
| 3,946,891 | 3/1976 | Picoy | 215/256 |
| 4,043,475 | 8/1977 | Wheeler | 215/256 X |
| 4,098,422 | 7/1978 | Slomski | 215/355 |
| 4,109,816 | 8/1978 | Faulstich | 215/256 |

FOREIGN PATENT DOCUMENTS

| | | | |
|---|---|---|---|
| 1273354 | 11/1963 | Fed. Rep. of Germany . | |
| 1422230 | 11/1965 | France . | |
| 92382 | 9/1968 | France | 215/256 |
| 922181 | 3/1963 | United Kingdom . | |
| 1073225 | 6/1967 | United Kingdom | 215/256 |

*Primary Examiner*—Donald F. Norton

*Attorney, Agent, or Firm*—Kane, Dalsimer, Kane, Sullivan & Kurucz

[57] ABSTRACT

A tamper indicating closure for use in combination with a container for spirits or liquors having a retaining means thereon, said closure having a crown with a plug portion dependent therefrom and adapted to engage the interior surface of the neck of the container, a skirt comprising a side wall, tear-away portion, and tamper indicating portions, depending from said crown and adapted to engage the external surface of said container wherein the tamper indicating portion is adapted to fit over said retaining means so as to be substantially unremovable therefrom when the closure is fully placed on the container, said closure only being removable by first removing the tear-away portion with the tamper indicating portion remaining on the container so as to indicate tampering to the consumer.

10 Claims, 5 Drawing Figures

TAMPER INDICATING CLOSURE AND PRESSURIZED CONTAINER

FIELD OF THE INVENTION

The present invention relates to an improved pressure retaining tamper indicating stopper or cork for a container for a pressurized beverage, particularly those used for sparkling wine such as champagne.

BACKGROUND OF THE INVENTION

There presently exists a wide variety of stoppers utilizable on pressure container or bottles in the spirit industry. These bottles may contain a variety of pressurized liquors of which champagne is perhaps best known and will be used as an example.

Traditionally, in champagne bottles, a cork stopper is placed in the neck of the bottle with the contents therein, and secured by a twisted wire cage, untwisting of which allowed removal of the cork. Cork stopper, in many applications, were replaced with stoppers made of plastic, and a removable metal strip, securing the stopper, took the place of the wire cage.

Initially, both these types of arrangements have the disadvantage of involving two separate pieces rather than a single piece, adding to their fabrication and assembly costs.

In addition, neither of these arrangements provide for tamper indication. While many tamper indicating closures presently exist, there are none which provide tamper indication which inhibits the re-use of the bottle. This is particularly important in the spirit industry where there is unauthorized re-use of the bottles or where genuine contents of a product are replaced with a bogus substitute and resealed.

SUMMARY OF THE INVENTION

Accordingly, it is an object of the invention to provide for a relatively simple and inexpensive tamper indicating cork, which leaves a portion thereof on the container after opening as an indicator to the consumer of tampering.

It is another object to provide for such a cork which in addition to indicating tampering, inhibits re-use of the bottle when emptied or replacement of genuine contents with bogus.

The present invention provides for a tamper indicating cork, molded out of a single piece and fabricated so as to eliminate the need for wires or metal strips to prevent the cork from exiting the bottle prematurely, while also providing tamper evidence to the consumer.

In this regard, the cork is of a molded, one piece construction with an inner plug portion having a plurality of sealing rings as well as a large annular sealing zone for engagement with the internal surfaces of the neck of the bottle. In addition to providing a seal, these surfaces on the plug portion generates sufficient friction to prevent the cork from being forced out of the bottle by the pressure of the bottle contents. An outer skirt extends over the neck finish of the bottle with a lower, inwardly extending tamper indicating ring adapted to fit over an annular flare or bead on the neck finish. A tear-away ring is provided on the skirt connecting the tamper indicating ring, and has an outer outwardly projecting tab located thereon. The tear-away ring is adapted to be removed manually while the tamper indicating ring is intended to remain on the neck finish of the bottle. The tamper indicating ring remains on the neck finish of the bottle between an upper sloping face of the annular flange or bead and the normal or perpendicular face of the lower side of said flange so as to be relatively fixed on said neck, and difficult, if not impossible to remove in a commercially feasible manner. In this way, since the tamper indicating ring is essentially fixed to the bottle, and difficult to remove, the use of the bottle as a container for bogus products is inhibited since an effective resealing of the bottle would not be possible and the tamper indicating ring would continue to provide tamper evidence to the consumer.

Once the tear-away ring is removed, the cork is then free to be removed from the bottle. The bottle is also provided with an upper bead at the upper end of its neck for force fitting with the internal surface of the skirt to provide additional friction in resisting untimely or premature removal of the cork.

The foregoing and other objects, features and advantages of the invention will be apparent in the following more detailed description which is to be taken in conjunction with the accompanying drawings.

DETAILED DESCRIPTION OF THE DRAWINGS

Figure 1:
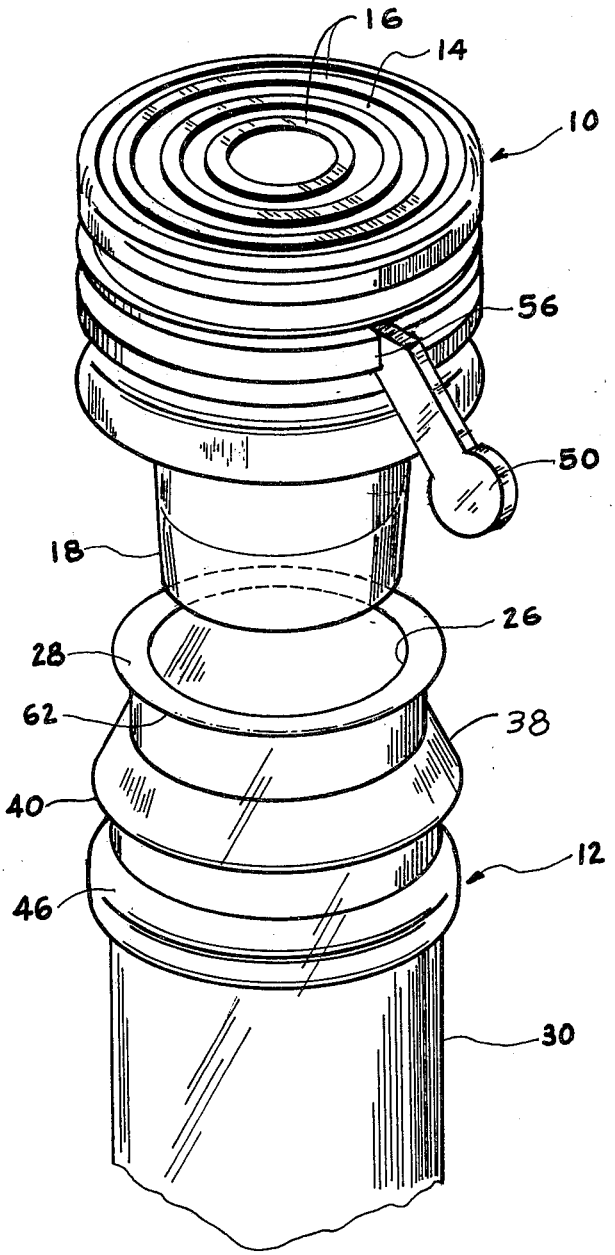
FIG. 1 is a perspective view of the tamper indicating cork prior to it being placed on the neck of a bottle, incorporating the features of the present invention.

In the figures there is shown a tamper indicating stopper or cork 10, which may be used on the neck of a container or bottle 12 which may contain champagne or other pressurized contents.

The cork 10 may be made of a plastic material, i.e., polyethylene etc., and is readily molded as a single piece using relatively small amounts of material in its fabrication. The cork is formed having a somewhat flat crown 14 having on its outer surface a plurality of annular ribs 16. Downwardly extending from the internal surface of the crown 14, is a cylindrical plug 18 which has located on its outer surface a plurality of sealing rings 20. The plug 18 is hollowed having an internal surface 22 whose diameter gradually decreases as you move upwards towards the crown 14. This varies the wall thickness of the plug 18, from a minimum at its tapered edge, to a maximum, adjacent the crown 14. The tapering of the plug 18, facilitates the entry of the plug 18 into the bottle 12 as the cork 10 is pushed thereon.

In addition to the sealing rings 20, an annular sealing zone 24 is provided and serves in conjunction with the sealing rings 20 to seal the contents of the bottle 12. This zone 24 can be seen most clearly in FIGS. 3 and 4 when the cork is fully inserted in the bottle 12. As shown, the sealing rings 20 engage the internal surface 26 of the bottle with the sealing zone engaging this surface and the top edge 28 of the neck of the bottle.

In addition to providing a sealing, rings 20 and zone 24 provide sufficient friction to prevent the cork from being forced out of the bottle prematurely by the pressure of the bottle contents. The present design provide for the cork 10 to withstand 35 to 100 p.s.i.

Figure 2:
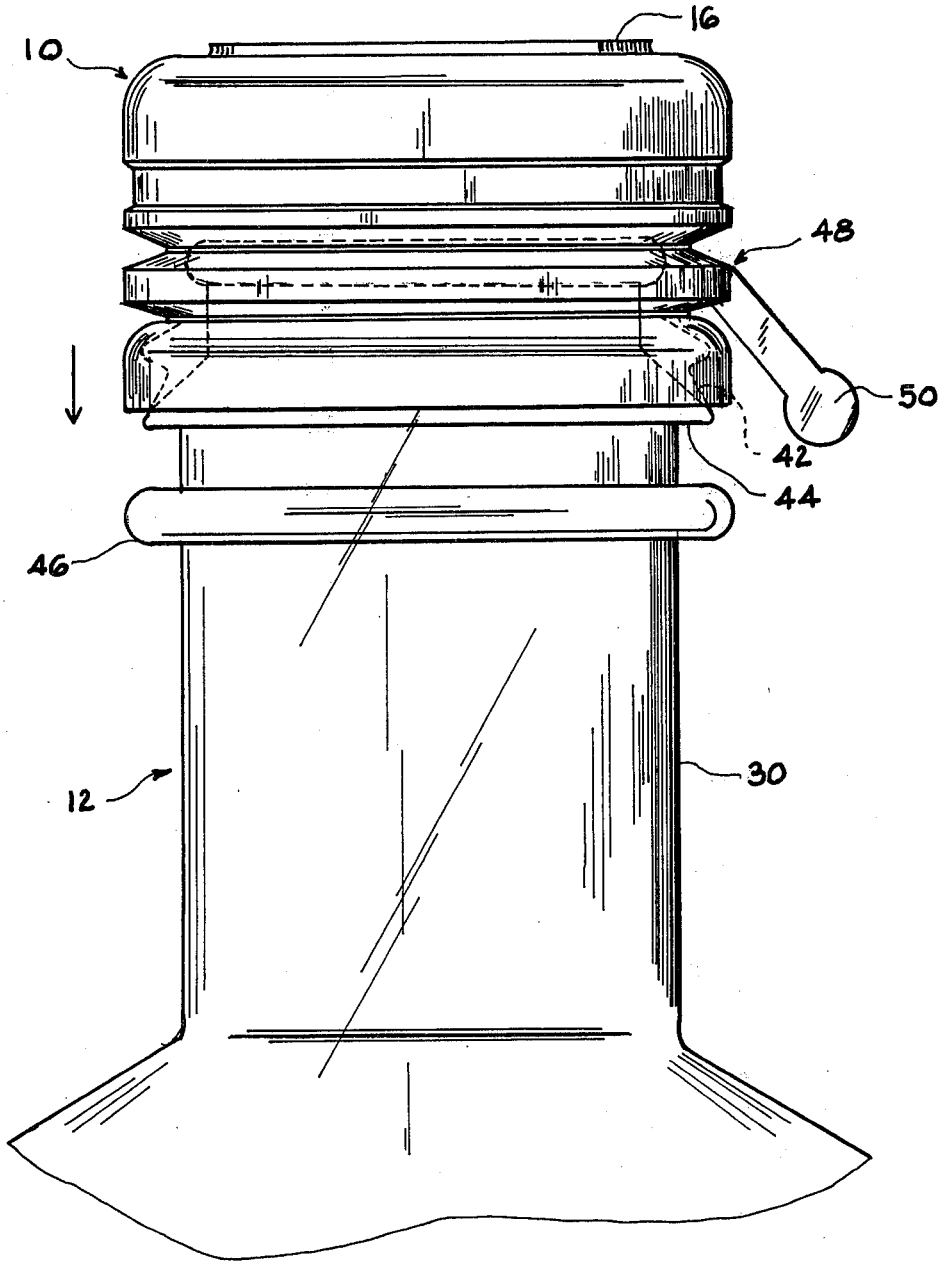
FIG. 2 is a partly sectional view of the tamper indicating cork as it is being placed on the neck of a bottle, incorporating the teachings of the present invention.

Also extending downwardly from the crown 14, is an annular outer skirt 28, which is adopted to extend over the outer surface 30 of the neck finish of the bottle 12. The skirt 28 is provided with a relatively straight inner wall surface 32 terminating in a notch 34 which is part of a tamper indicating ring 36. This ring 36 is adapted to fit over an annular retaining means, bead or flange 38 located on the neck finish of the bottle 12. Flange 38 has an upper sloping surface or face 40 which facilitates the outward expansion of the ring 36 as it is fitted thereover, as is illustrated in FIG. 2. This sloping surface 40 is preferably at 45° relative to the surface 30 of the neck. To aid in this, the inner face 42 of the ring 36 may angle outward in a downward direction, so as to gradually allow the outward expansion of the ring 36.

Figure 3:
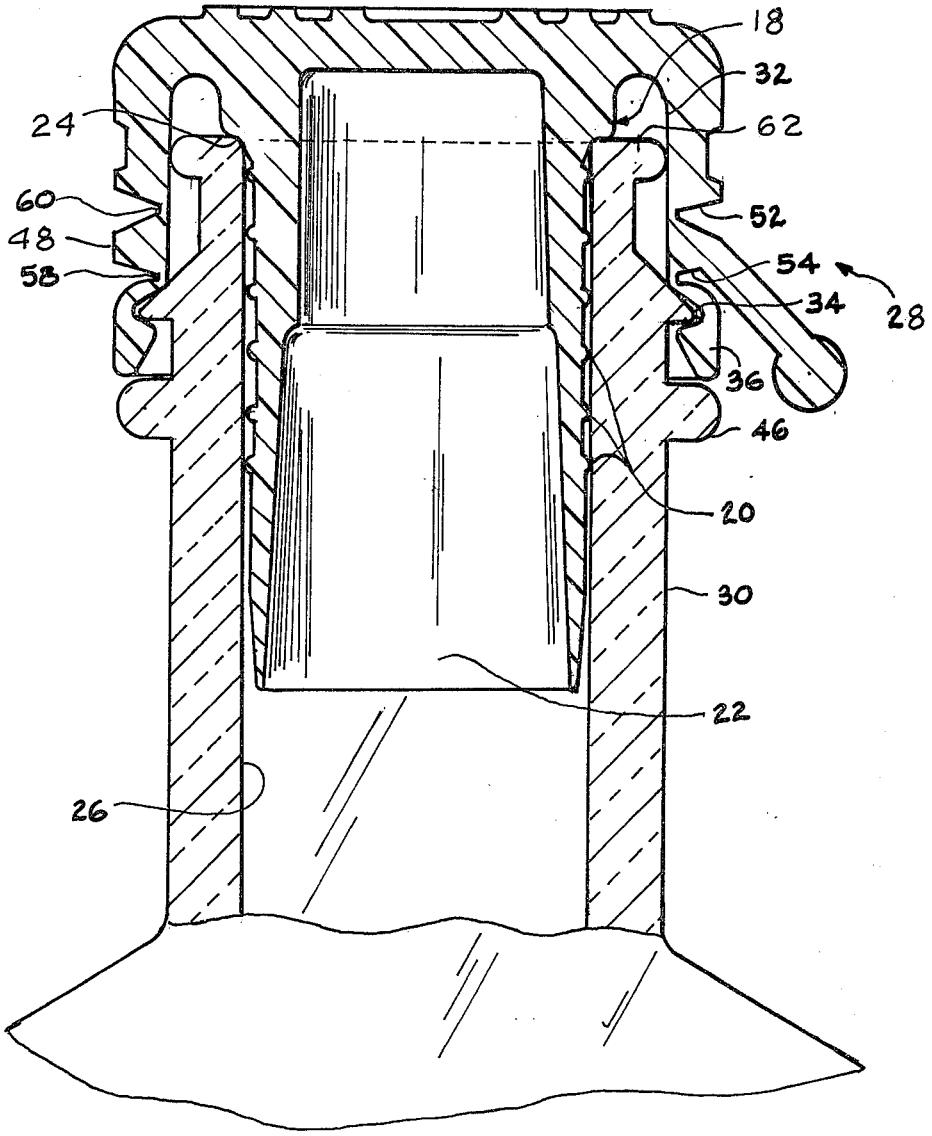
FIG. 3 is a sectional view of the tamper indicating cork which is fully placed on the neck of a bottle incorporating the teachings of the present invention.
Figure 4:
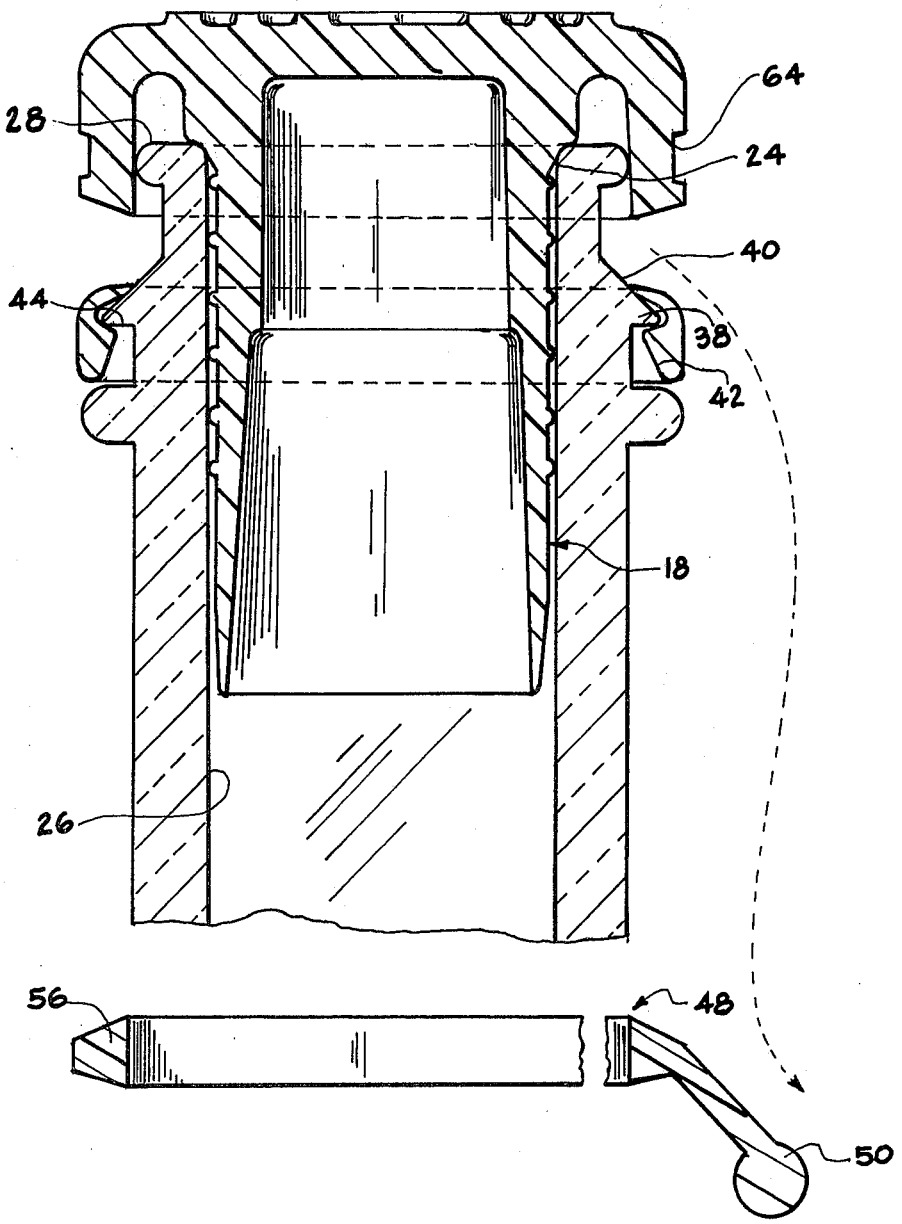
FIG. 4 is a sectional view of the tamper indicating cork located on the neck of a bottle with the tear-away ring removed.
Figure 5:
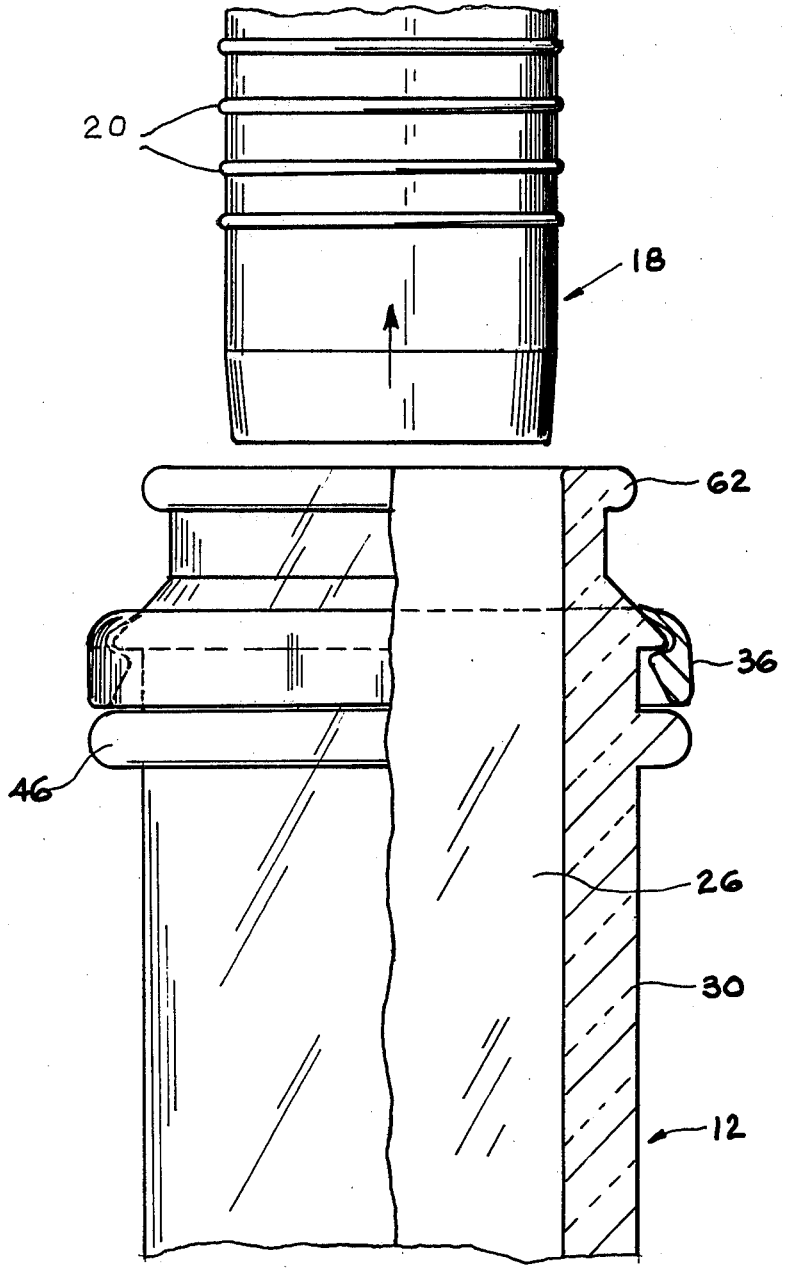
FIG. 5 is a partly sectional view of the tamper indicating cork as it is being removed from the neck of the bottle with the indicating ring remaining on the neck finish of the bottle.

The sloping face 40 terminates in a lower face 44 which is normal or perpendicular to the outer surface 30 of the bottle. Spaced below the lower face 44, is an annular flange or bead 46, with the bead 46, surface 30 and face 44 defining an area in which the tamper indicating ring 36 is positioned, with the notch 34 and flange 38 holding ring 36 fixedly as shown in FIGS. 3–5.

The diameter of the bead 46 and the tolerances of the ring 36 should be such that the ring 36 is positioned rather snugly in the area aforementioned, with the ability to pry the ring all but eliminated, effectively keeping the ring 36 on the bottle throughout its use, and indicating tampering as to the consumer.

Adjacent the tamper indicating ring 36 is a tear-away ring 48 provided with an outwardly projecting tab 50. The ring 48 is formed out of the skirt 28, by providing two annual and parallel V-shaped notches, 52 and 54 respectively. A transverse score 56 adjacent the tab 50 is provided to allow removal of the ring 48 from the skirt when desired. In this regard, and as can be seen most clearly in FIG. 4, once the cork 10 is fully located on the neck of the bottle, with the tamper indicating ring 36 fixed in place, to remove the cork, the tear-away ring 48 must first be removed which may accomplish pulling on tab 50. This causes the tear-away ring to severe from the skirt and ring 36 at frangible portions or tear lines 58 and 60 where the skirt wall is the thinnest, with the score 56 allowing the ring 48 to be pulled entirely from the cork and then discarded. It should be noted that the skirt wall at portion 58 should be sufficiently resilient to allow the ring 36 to expand outwardly when being fitted over flange 38 without rupturing.

Once the tear-away ring 48 is removed, the cork would still remain securely on the bottle due to the frictional engagement of zone 24 and sealing rings 20 with the internal surface 26 of the bottle. In addition, the neck of the bottle at edge 28 may be provided with an annular upper bead 62 which would engage the inner surface 32 of the skirt to provide additional frictional force in resisting untimely or premature removal fo the cork, if so desired. After removal of ring 48, the cork would then be free to be removed from the bottle, as shown in FIGS. 4 and 5. This may be accomplished by grasping the skirt and pulling upward with sufficient force to overcome the frictional forces aforementioned, as done in conventional cork removal. In this regard, an annular indentation 64 may be provided to facilitate such grasping.

The tampering indicating ring 36 remains on the neck of the bottle after removal of the tear-away ring 48 and subsequently the cork 10. Due to the engagement of the notch 34 with the flange 38, and the use of the annular bead 46, the tamper indicating means remains relatively fixed on the bottle as aforementioned. In that it would be difficult to pry ring 36 off of the bottle, this would inhibit an unauthorized opening of the bottle to substitute bogus contents therein, or to otherwise re-use the bottle again with bogus contents, for sale as genuine contents. This would prevent a resealing of the bottle and continually allow tamper evidence to the consumer.

While a detailed description of the preferred embodiment has been described herein, it should not be restricted thereby, rather its scope should be determined by that of the appended claims.

What is claimed is:

1. A one-piece molded plastic tamper indicating closure in combination with a pressurized container such as a champagne bottle, said closure comprising:

a crown;

a plug portion downwardly depending from said crown engaging the interior surface of the neck to provide sufficient bearing and sealing forces therebetween so as to prevent undesired or premature ejection of the closure from the container, the plug portion being cylindrical in nature, having a plurality of sealing means located thereon engaging the interior surface of the neck so as to resist withdrawal of the plug portion therefrom;

a skirt comprising a side wall depending from said crown a distance substantially less than the plug portion with said skirt fitting over the exterior of the neck;

a tamper indicating portion including a radially inwardly projecting wedge shaped internal ring and located below said side wall;

a tear-away portion connecting said side wall and said tamper indicating portion and adapted to be removed to separate said side wall from said tamper indicating portion;

the pressurized container having a neck with a retaining means thereon, said retaining means including a flange having an upper surface which slopes downward and terminates in a bottom surface, said container having an annular bead located below said bottom surface with a portion of the tamper indicating portion located between said annular bead and said bottom surface when the closure is fully placed on the container, and said bead being of sufficient size so as to inhibit removal of the tamper indicating portion from the container, the diameter of the bead and the dimensional tolerances of the ring being such that the ring is positioned snugly between the bead and the bottom surface of the retaining means so as to be substantially fixed therebetween on the neck so as to prevent prying of the ring off the neck;

said closure being integrally constructed and capable of sealing the container by being axially forced thereon while being sufficiently resilient to allow the tamper indicating portion to yielding slide over the retaining means when the closure is forced on the container with said tamper indicating portion so positioned so as to be substantially unremovable therefrom; and whereby when the closure is fully placed on the neck of the container removal of the closure therefrom is prevented due to the engagement of the plug portion, the tamper indicating portion and the retaining means, the closure being only removable by removing the tear-away portion with the tamper indicating portion remaining on the container as an indicator of tampering to the user.

2. The combination in accordance with claim 1 wherein said plug portion includes a sealing zone which engages said interior surface of the neck providing a seal therebetween while resisting withdrawal of the plug therefrom.

3. The combination in accordance with claims 1, or 2 wherein said tear-away portion is formed by two spaced parallel notches in said skirt, connected by a transverse score, thereby allowing removal of said tear-away portion from said closure by pulling therefrom.

4. The combination in accordance with claim 3 wherein said tear-away portion includes a tab connected thereto to facilitate the removal of the tear-away portion from the closure by grasping and pulling on said tab.

5. The invention in accordance with claim 1 wherein the tamper indicating portion comprises an annular ring having a notch portion adapted to engage the retaining means so as to be substantially unremovable therefrom.

6. The combination in accordance with claim 5 wherein said notch engages with said flange.

7. The combination in accordance with claim 1 wherein said container includes an upper ring located above said retaining means, wherein said upper ring is adapted to engage the side wall so as to resist withdrawal of the closure from said container.

8. The combination in accordance with claim 1 is made from a resilient material such as polyethylene.

9. The combination in accordance with claim 1 wherein the upper surface of said flange slopes at an angle of 45° with the bottom surface normal to the exterior surface of the neck of the container.

10. The combination in accordance with claim 1 wherein said plug has a hollow interior, and at least 6 sealing rings located on the exterior surface of said plug.

* * * * *